United States Patent [19]

Barton, Sr.

[11] Patent Number: 4,520,649

[45] Date of Patent: Jun. 4, 1985

[54] VEHICLE ANCHORING STAND

[76] Inventor: George D. Barton, Sr., Rte. 2, Box 103, Clear Creek Rd., Mabank, Tex. 75147

[21] Appl. No.: 519,231

[22] Filed: Aug. 2, 1983

[51] Int. Cl.[3] ..... B21D 1/12

[52] U.S. Cl. ..... 72/457; 72/705; 248/352; 254/DIG. 1

[58] Field of Search ..... 72/705, 457; D34/31; D15/199; 52/704, 706, 708, 711; 248/352

[56] References Cited

U.S. PATENT DOCUMENTS

| | | | |
|---|---|---|---|
| 2,439,854 | 4/1948 | Lipski | 248/352 |
| 3,091,278 | 5/1963 | Padgett | 72/705 |
| 3,990,207 | 11/1976 | Eck et al. | 52/704 |
| 4,064,668 | 12/1977 | Carter | 248/352 |
| 4,337,636 | 7/1982 | Clausen | 72/705 |
| 4,344,314 | 8/1982 | Aldrick et al. | 72/705 |
| 4,400,969 | 8/1983 | Specktor | 72/705 |

*Primary Examiner*—Lowell A. Larson
*Attorney, Agent, or Firm*—Harvey B. Jacobson

[57] ABSTRACT

A horizontal base plate structure is provided having a central opening therein and a plurality of marginal portions spaced about the central opening and disposed in a plane slightly spaced below the portions of the base plate structure defining the central opening. Upright central post structure is supported from a central portion of the base plate structure and attaching structure is carried by the upper end portion of the central post structure for attachment to a vehicle frame. Also, anchor structure is carried by the base plate structure and operative through the central opening therein for engagement with and tightly drawing the central portion of the base plate structure downwardly relative to a floor anchor over which the base plate structure may be disposed. In addition, the central post structure includes circumferentially spaced adjustable length elongated downwardly and outwardly inclined braces connected between circumferentially spaced portions of the upper end portion of the central post structure and the aforementioned marginal portions of the base plate structure. By tightly drawing downwardly on the central portion of the base plate structure, the latter is slightly flexed and the braces are placed under compression to rigidly brace the floor engaging marginal portions of the base plate structure with the floor upon which the base plate is disposed relative to the corresponding circumferentially spaced portion of the upper end portion of the central post structure.

12 Claims, 14 Drawing Figures

VEHICLE ANCHORING STAND

BACKGROUND OF THE INVENTION

Various forms of stand and floor anchors heretofore have been designed for anchoring a vehicle frame or other structure relative to a floor in order to enable straightening pulls to be applied to the frame or other structures in order to bend the same. However, most previously known forms of anchoring stands are not capable of withstanding heavy lateral forces throughout a 360° zone extending about a vertical axis extending centrally through the stand. For this reason, many forms of stands require various different forms of special floor and straightening frame bracing members. However, these floor and straightening frame bracing members are time consuming to install and dismantle and present obstructions to movement of persons about the frame or other structures to be straightened. Accordingly, a need exists for an improved form of vehicle frame or other structure anchoring stand which may be utilized to support a vehicle frame or other structure to be straightened in stationary position relative to a work surface such as a concrete floor and with the stand being capable of withstanding heavy lateral loads throughout a 360° zone extending about a vertical axis extending through the stand.

Examples of various forms of anchoring stands including some of the general structural and operational features of the instant invention are disclosed in U.S. Pat. Nos. 3,091,278, 3,754,427, 4,236,400, 4,337,636 and 4,344,314.

BRIEF DESCRIPTION OF THE INVENTION

The stand of the instant invention includes a horizontal base structure including a central opening formed therein and a plurality of marginal portions spaced about the central opening and disposed in a plane spaced slightly below the portions of the base structure defining the aforementioned central opening. Upright central post structure is supported from a central portion of the base structure and attaching structure is carried by the upper end portion of the central post structure for anchoring to a vehicle frame. Anchor structure is carried by the base structure and operative through the aforementioned opening to engage a floor anchor and to tightly draw the central portion of the base structure downwardly toward the floor anchor. In addition, elongated upwardly and inwardly inclined adjustable length braces are connected between the aforementioned marginal portions of the base plate structure and corresponding peripherally spaced portions of the upper end portion of the central post structure. As the anchor structure is operated to downwardly draw the central portion of the base structure toward an associated floor, the braces are placed in longitudinal compression and thus rigidly brace the upper end portion of the central post structure against horizontal deflection throughout a 360° zone extending about the center axis of the post structure. In this manner, a vehicle frame anchoring stand is provided which will greatly resist heavy lateral loading throughout a 360° zone extending about the center vertical axis of the stand.

The main object of this invention is to provide an improved floor anchor for support of a vehicle frame from a floor and with the supported frame held rigid against horizontal shifting relative to the floor in all directions.

Yet another object of this invention is to provide a vehicle frame support and anchoring stand which may be used in conjunction with conventional forms of floor anchors.

Another very important object of this invention is to provide a vehicle frame support and anchoring stand which may be adjusted in height.

Yet another object of this invention is to provide a vehicle frame support and anchoring stand including attaching structure on its upper end for rigid releasable attachment to various different portions of a vehicle frame.

A final object of this invention to be specifically enumerated herein is to provide a vehicle frame support and anchoring stand in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
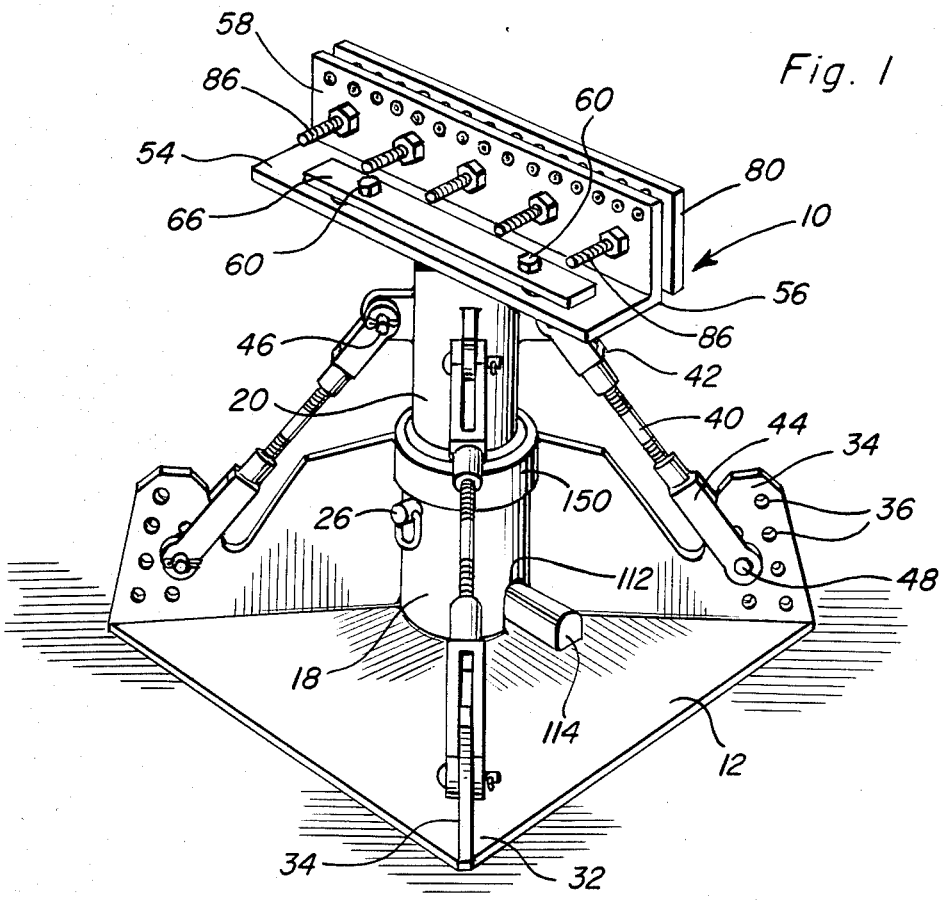
FIG. 1 is a perspective view of the vehicle frame anchoring stand of the instant invention.
Figure 2:
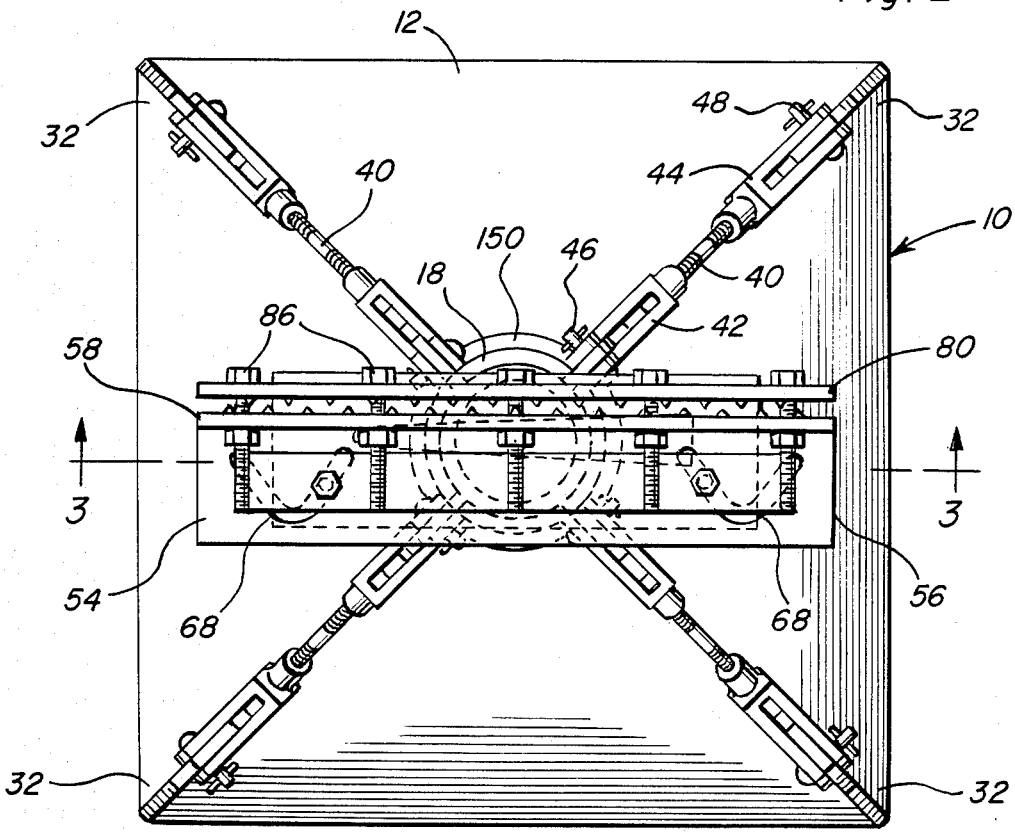
FIG. 2 is an enlarged top plan view of the stand.

Referring now more specifically to the drawings, the numeral 10 generally designates the vehicle frame support and anchoring stand of the instant invention. The stand 10 includes a horizontal base plate 12 which is square in plan shape and includes a central opening 14 formed therein. The lower end of an upright central post structure referred to in general by the reference numeral 16 is anchored to the base plate 12 about the opening 14 in any convenient manner such as by welding. The post structure 16 includes a large diameter lower tubuler end portion 18 and a smaller diameter upper end portion 20 which is slidingly and telescopically received downwardly into the upper end of the lower end portion 18. The upper end portion 20 includes vertically spaced pairs of diametrically opposite radial bores 22 formed therein and the upper end of the lower end portion 18 includes a pair of diametrically opposite radial bores 24 formed therein with which selected pairs of the bores 22 are registrable. A removable locking pin 26 is passed through the bores 24 and a selected pair of the bores 22 in order to releasably secure the post structures 16 in adjusted extended or retracted positions.

Figure 4:
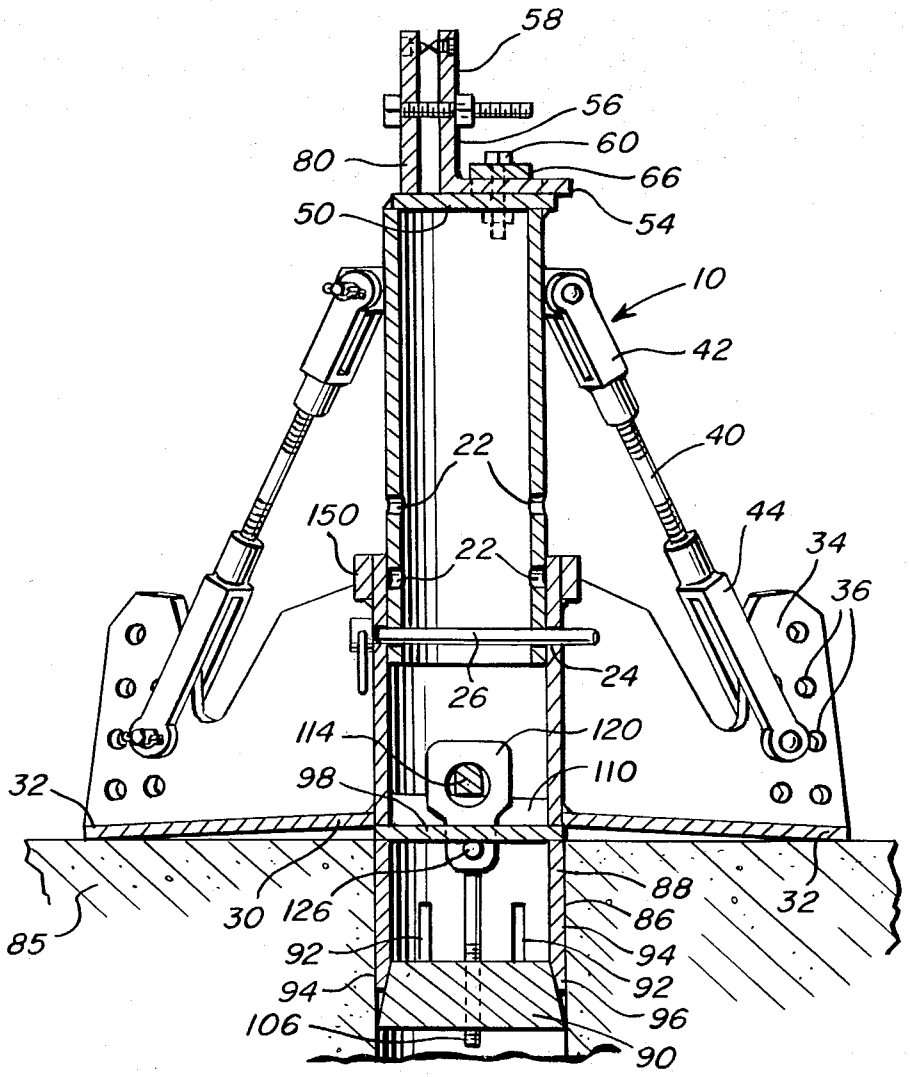
FIG. 4 is a vertical sectional view taken substantially upon the plane indicated by the section line 4—4 of FIG. 3.
Figure 3:
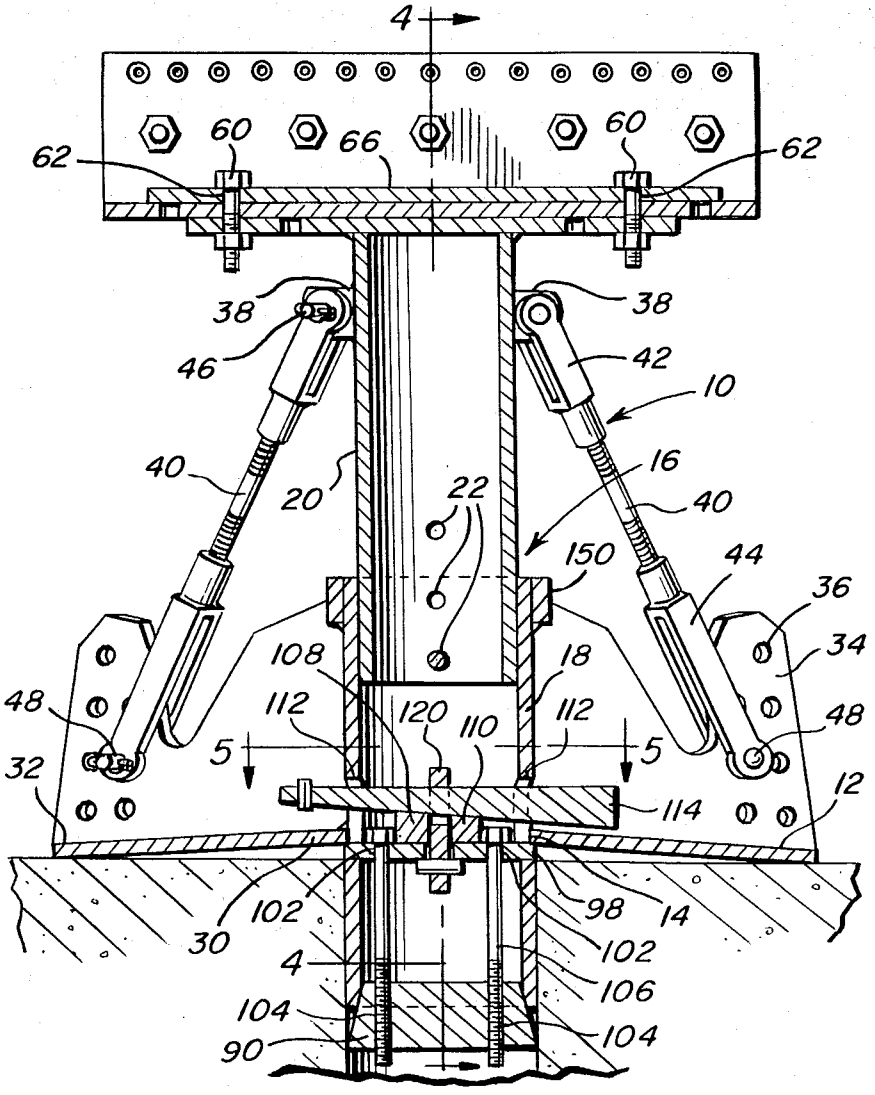
FIG. 3 is a vertical sectional view taken substantially upon the plane indicated by the section line 3—3 of FIG. 2.
Figure 5:
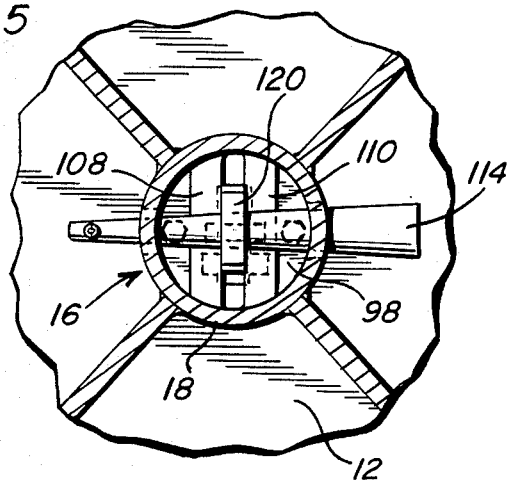
FIG. 5 is a fragmentary horizontal sectional view taken substantially upon the plane indicated by the section line 5—5 of FIG. 3.

As may best be seen from FIGS. 3 and 4 of the drawings, the base plate 24 includes a central portion 30 in which the opening 14 is formed and the four outer peripheral corner portions 32 of the base plate 12 are spaced equally circumferentially about the central portion 30. Each of the corner portions 32 is braced relative to a corresponding peripheral portion of the lower end portion 18 by a vertical gusset plate 34 extending generally radially of the lower end portion 18 and the gusset plates 34 include variously vertically and horizontally spaced apertures 36 formed therethrough. In addition, the upper end of the upper end portion 20 includes circumferentially spaced mounting ears 38 disposed generally in the same radial planes of the post structure 16 as the gusset plates 34.

Four adjustable length outwardly and downwardly inclined braces 40 equipped with opposite upper and lower end yokes 42 and 44 have the upper end yokes thereof anchored relative to corresponding mounting ears 38 by removable pin 46 and the lower yokes 44 thereof anchored relative to corresponding gusset plates 34 by removable pins 48 passed through the yokes 44 and selected apertures 36 formed in the gusset plates 34. The braces 40 are of heavy duty construction and may withstand considerable axial compression.

The upper end of the upper end portion 20 is closed by a horizontal mounting plate 50 extending transversely thereof and including pairs of opposite end transverse slots 52 formed therein. The horizontal flange 54 of an angle member 56 also including a vertical flange or plate 58 is anchored to the mounting plate 50 by suitable bolt-type fasteners 60 passed through bores 62 provided therefor in opposite ends of a clamp bar 66, V-shaped slots 68 formed in the horizontal flange 54 and the slots 52 formed in the mounting plate. Because of the unique combination of the straight transverse slots 52 and the V-shaped slots 68, the angle member 56 may be secured in adjusted angular position relative to the mounting plate 50. The vertical flange or plate 58 includes a plurality of longitudinally spaced horizontal bores 70 formed therethrough centrally intermediate its upper and lower marginal portions and a plurality of gripping point defining threaded fasteners 72 are threadedly secured through threaded bores 74 formed in and spaced along the upper marginal edge of the vertical flange 58 and including counterbores 76 on the included angle side of the vertical flange 58, the counterbores 76 receiving and recessing the heads 78 of the fasteners 72 therein. A clamping plate 80 is provided and opposes the excluded angle side of the vertical flange or plate 58 and has horizontal bores 82 formed therethrough corresponding to the horizontal bores 70 and through which clamping bolts 86 may be received. In addition, the upper marginal edge of the clamping plate 80 includes gripping point defining threaded fasteners 84 removably threadedly supported therefrom corresponding to the gripping point defining fasteners 72.

The stand 10 may be placed upon a concrete floor 85 having an upstanding blind bore 86 formed therein and a vertical sleeve 88 may be snugly received in the bore 86 above a frusto-conical wedge 90 seated in the bottom of the bore 86. The lower end of the sleeve is provided with circumferentially spaced vertically downwardly opening slots 92 defining expandable fingers 94 between adjacent slots 92 and the inner marginal edges of the lower ends of the fingers 94 are beveled as at 96 for wedging coaction with the wedge 90. The upper end of the sleeve 88 has a circular plate 98 disposed thereover and the plate 98 is provided with a cross-shaped opening 100 formed therethrough as well as a pair of bores 102 which are registrable with threaded bores 104 formed through the wedge 90. A pair of anchor bolts 106 are passed downwardly through the bores 102 and tightened in the bores 104 in order to draw the plate 98 tightly downwardly against the upper end of the sleeve 88 and to wedge the upper end of the wedge 90 into the lower end of the sleeve 88 and thus tightly anchor the sleeve 88 within the concrete floor 85.

The lower end of the lower end portion 18 closely opposes the plate 98 and has a pair of high and low wedge leveling bars 108 and 110 secured thereacross in any convenient manner. Opposite side portions of the lower end portion 18 include wedge receiving openings 112 formed therein and an elongated wedge 114 is receivable through the openings 112 above the bars 108 and 110.

Figure 6:
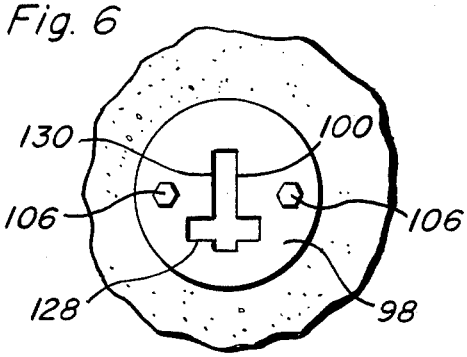
FIG. 6 is a plan view of a first form of floor anchor.
Figure 8:
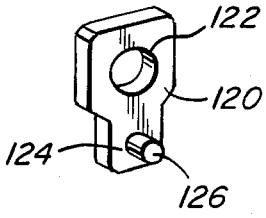
FIG. 8 is a perspective view of an anchor structure to be utilized in conjunction with the central portion of the base of the stand and the floor anchor illustrated in FIG. 6 for the purpose of tightly drawing the central portion of the base of the stand downwardly toward the floor from which the floor anchor of FIG. 6 is supported.
Figure 9:
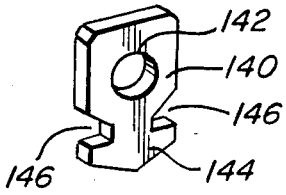
FIG. 9 is a perspective view of an anchor structure similar to the anchor structure of FIG. 8 but designed to be utilized in conjunction with the floor anchor illustrated in FIG. 7.

A vertically disposed anchor plate 120, see FIG. 8, is provided and includes an upper end portion including a circular horizontal opening 122 formed therethrough and a reduced width lower end portion 124 having an anchoring pin 126 secured therethrough. The anchoring pin 126 may be received through the transverse portion 128, see FIG. 6, of the opening 100 and thereafter shifted to a position centrally intermediate the longer longitudinal portion 130 of the opening 100 in order to anchor the anchor pin below the plate 98. In this position, the opening 122 of the anchor plate 120 is registered with the openings 112 and the wedge 114 may be passed through the openings 112 and the opening 122 and driven tight in order to tightly draw the lower end of the lower end portion 18 downwardly to abutting engagement with the upper surface of the plate 98. However, before the lower end of the lower end portion 18 abuts the plate 98, the corner portions 32 of the base plate 12 will engage the floor 85 and thus as the lower end of the lower end portion 18 is finally wedged downwardly into engagement with the plate 98, the base plate 12 will have its corner portion 32 tightly engaged with the floor 85 and the base plate 12 will be slightly flexed in order to place the braces 40 under considerable longitudinal compression. In this manner, lateral deflection of the upper end portion of the post structure 16 is strongly resisted. Of course, any portion of a vehicle frame, subframe or unibody frame may be clamped between the flange 58 and the clamp plate 80 and gripped by point defining fasteners 72.

Figure 7:
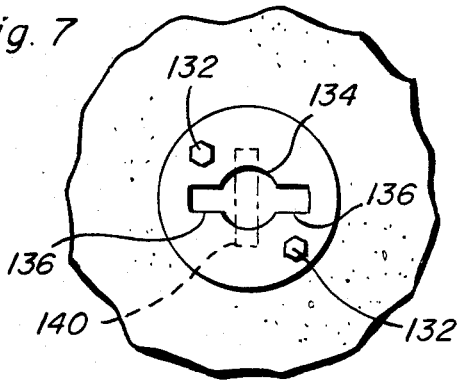
FIG. 7 is a plan view of a second form of floor anchor.
Figure 10:
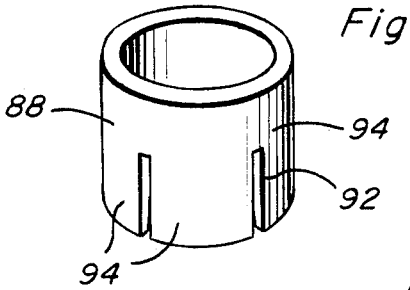
FIG. 10 is a perspective view of the slotted expandable sleeve portion of the floor anchor portion of the invention.
Figure 11:
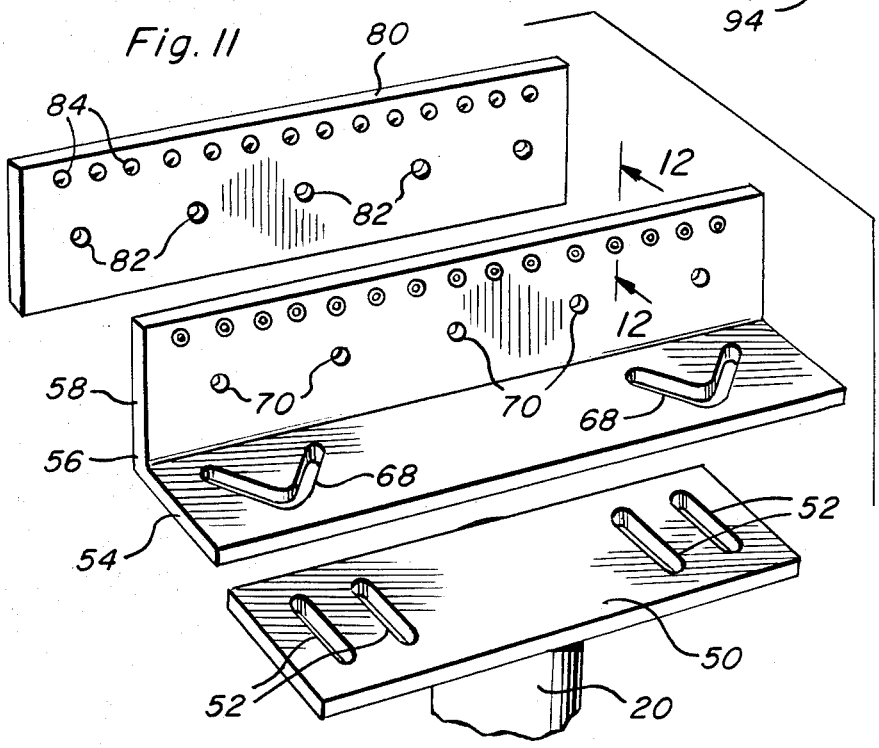
FIG. 11 is an exploded perspective view of the frame attaching structure carried by the upper end of the central post of the anchoring stand.
Figure 12:
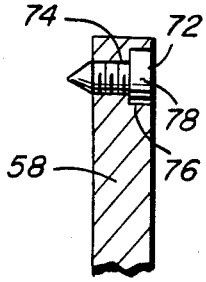
FIG. 12 is a fragmentary vertical sectional view of the clamping flange portion carried by the upper end of the stand for clampingly engaging a structure to be straightened.

With attention now invited more specifically to FIG. 7 of the drawings, there will be seen a second form of floor anchored top plate referred to in general by the reference numeral 130 and which is similar to the plate 98 and secured relative to the wedge 90 by bolts 132 corresponding to the bolts 106. However, the plate 130 is provided with a central opening 134 including radially and outwardly extending diametrically opposite portions 136 and an anchor plate 140 corresponding to the anchor plate 120 and including an opening 142 formed thereto corresponding to the opening 122 is provided and includes a lower end portion 144 provided with opposite side notches 146. The anchor plate 140 is downwardly insertable through the opening 134 with the notches 146 aligned with the portions 136. Thereafter, the anchor plate 140 may be rotated 90° to the phantom line position thereof illustrated in FIG. 7 in order to lock the anchor plate 120 against vertical shifting relative to the plate 130.

Figure 13:
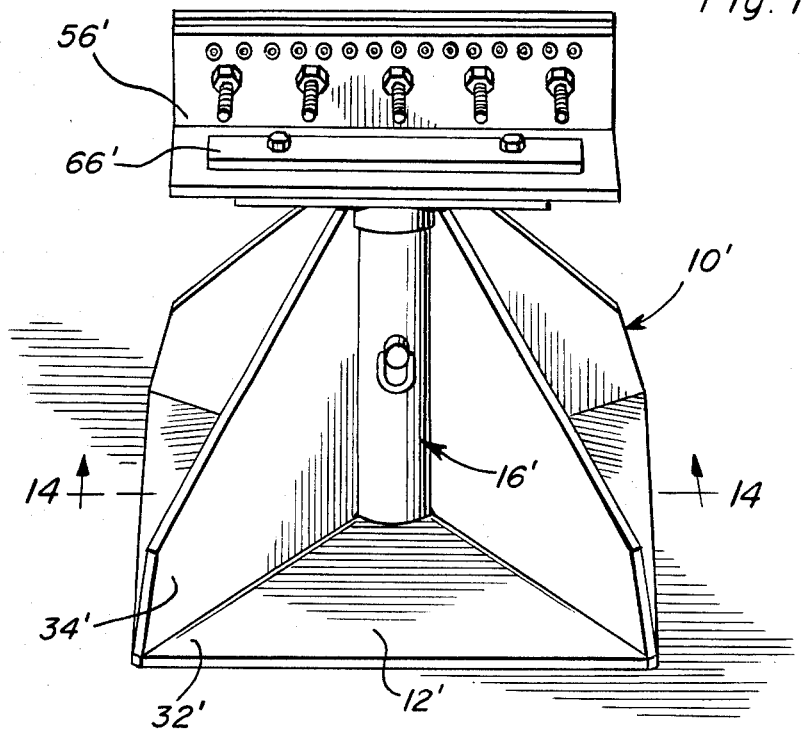
FIG. 13 is a perspective view of a simplified second form of vehicle frame supporting and anchoring stand.
Figure 14:
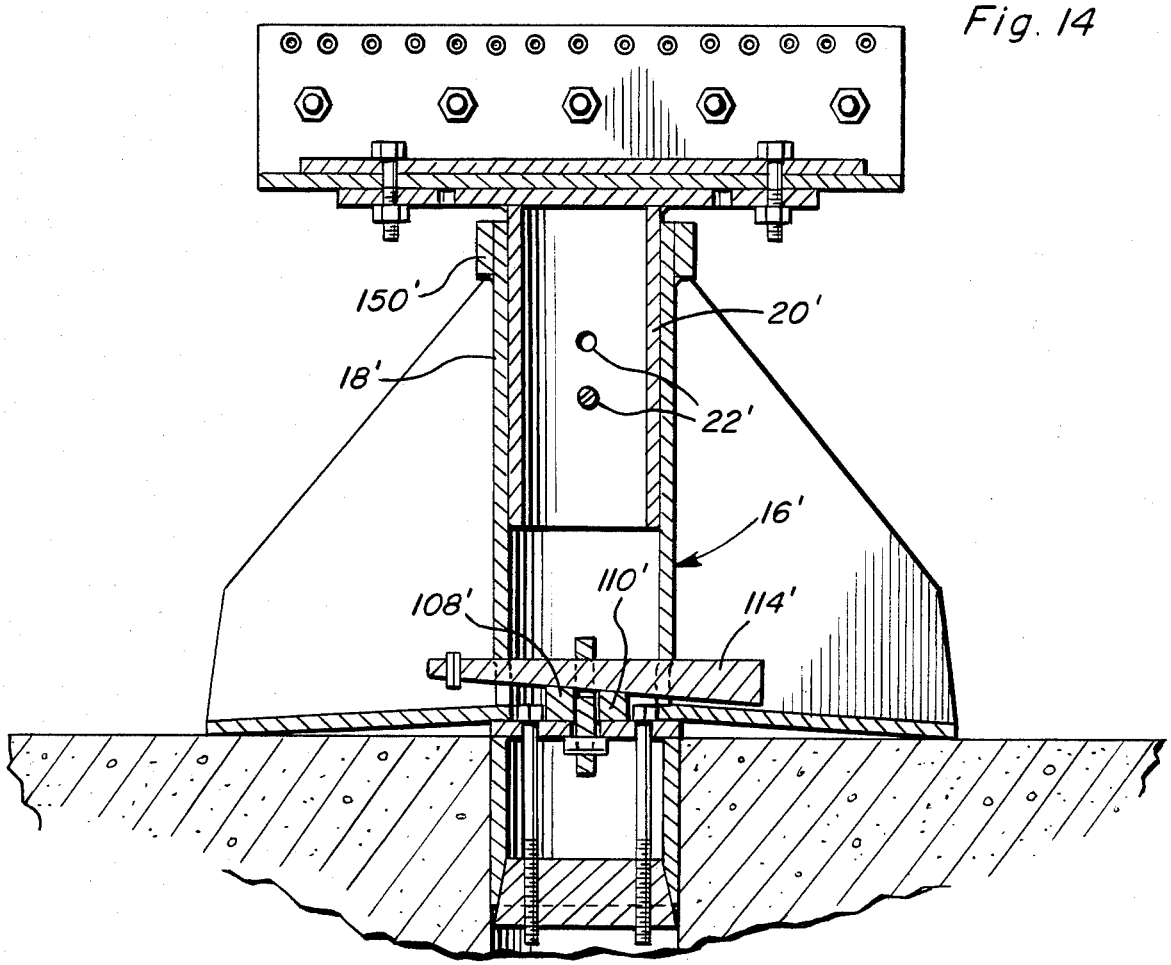
FIG. 14 is an enlarged vertical sectional view taken substantially upon the plane indicated by the section line 14—14 of FIG. 13.

In FIGS. 13 and 14 of the drawings, there may be seen a modified form of stand referred to in general by the reference numeral 10' and which is very similar to the stand 10 and has the various components thereof corresponding to similar components of the stand 10 designated by prime reference numerals correpsonding to those designating the similar components of the stand 10. The major difference between the stand 10' and the stand 10 is that the gusset plates 34' of the stand 10' extend from the corner portions 32' of the base plate 12' to corresponding peripherally spaced portions of the upper end of a taller lower end portion 18' of the post structure 16'. The lower end portion 18' is of greater vertical extent than the lower end portion 18 and the upper end portion 20' of the post structure 18' includes only two vertically spaced pairs of diametrically opposite radial bores 22' formed therein. Accordingly, the central post structure 16' of the stand 10' is adequately braced relative to the corner portions 32' of the base plate 12'. Otherwise, the stands 10 and 10' are substantially identical. It will be noted that the upper end of the lower end portion 18 is equipped with a reinforcing ring 150 and that the upper end of the lower end portion 18' is provided with a similar reinforcing band or ring 150'.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A vehicle anchoring stand including horizontal base structure having a central opening therein and a plurality or outer marginal portions spaced about said central opening and disposed in a plane spaced slightly below the central portion of said base structure defining said opening, upright central post structure supported from said central portion of said base structure, attaching structure carried by the upper end portion of said central post structure for anchoring to a vehicle frame, and anchor means carried by said base structure and operative through said opening for tightly drawing said central portion of said base structure downward relative to a flor anchor, said base structure being slightly flexive whereby downward drawing of said central portion relative to said floor anchor will insure tight full seated engagement of said marginal portions with opposing floor surfaces disposed about said floor anchor, brace structure extending and connected between said marginal portions and corresponding peripherally spaced portions of upper portions of said central post structure, whereby flexing of the base structure as said central portion is draw downward toward said floor anchor will place said upper portions of said central post structure under compression through said brace structure to thus resist lateral deflection of said central post structure.

2. The anchor structure of claim 1 wherein said brace structure comprises gusset plates disposed, generally, in radial planes of said central post structure.

3. The anchor structure of claim 1 wherein said brace structure includes a plurality of inclined braces extending and secured between said marginal portions and said corresponding peripherally spaced portions of the upper portions of said central post structure.

4. The anchor structure of claim 1 including a floor anchor for anchoring within an upstanding bore formed in a floor structure, said floor anchor including an upstanding sleeve having lower end peripherally spaced and longitudinally extending fingers on its lower end, circular wedge means wedgingly receivable in the lower end of said sleeve between said fingers for radially outwardly displacing the latter, and connecting means connected between the upper end of said sleeve and said wedge means for drawing said wedge means upwardly between said fingers.

5. The anchor structure of claim 4 wherein said connecting means includes a top plate overlying the upper end of said sleeve having peripherally spaced bores formed therethrough and threaded tension members secured through said bores and threadedly engaged with corresponding peripherally spaced portions of said wedge means.

6. The anchor structure of claim 5 wherein said top plate includes a non-circular opening formed therethrough, a vertical disposed anchor plate including a lower end portion downwardly receivable through said non-circular opening and operative to prevent said lower end portion from being withdrawn upwardly through said non-circular opening upon selected displacement of said anchor plate relative to said top plate, said anchor plate and opposite side portions of the lower end of said central post structure including horizontally registrable openings formed therethrough, said anchor means additionally including horizontal wedge means receiving through said horizontally registered openings.

7. The stand of claim 1 including an upper horizontal mount carried by the upper end of said central post structure, clamp structure defining a horizontally elongated clamping zone, means mounting said clamp structure from said upper mount for selective horizontal shifting of said clamp structure longitudinally of said zone relative to said upper mount, transversely of said zone relative to said upper mount and in angularly displaced positions relative to said upper mount about an upstanding axle.

8. The anchor stand of claim 7 wherein said horizontally elongated clamping zone is defined between opposing plate portions having means connected therebetween for forcibly reducing the spacing between said plate portions.

9. The anchoring stand of claim 8 wherein each of said flange portions include outwardly projecting pointed gripping members projecting toward the other flange portion.

10. The anchoring stand of claim 1 wherein said upright central post structure include means for adjusting the effective vertical extent thereof.

11. The anchor structure of claim 10 wherein said inclined braces comprise adjustable length brace members.

12. The anchor structure of claim 11 wherein said adjustable length brace members comprise brace members threadedly adjustable in length.

* * * * *